United States Patent [19]

Mesa

[11] Patent Number: 4,704,759

[45] Date of Patent: Nov. 10, 1987

[54] BACK SCRUBBING DEVICE

[76] Inventor: Onelio Mesa, 6646 N.W. 181 La., Miami, Fla. 33014

[21] Appl. No.: 818,454

[22] Filed: Jan. 13, 1986

[51] Int. Cl.[4] ..... A47K 7/02

[52] U.S. Cl. ..... 15/160; 15/110; 4/606

[58] Field of Search ..... 15/160, 110; 4/606, 4/605

[56] References Cited

U.S. PATENT DOCUMENTS

| | | | |
|---|---|---|---|
| D. 260,563 | 9/1981 | Walsh, Jr. | 15/160 X |
| 1,954,940 | 4/1934 | Mikel | 15/110 X |
| 3,008,164 | 11/1961 | Herman et al. | 15/160 |
| 3,631,560 | 1/1972 | Atkins | 15/160 X |
| 3,750,226 | 8/1973 | Morgan | 15/187 |
| 4,417,362 | 11/1983 | Walker | 4/606 |

*Primary Examiner*—Peter Feldman

*Attorney, Agent, or Firm*—John C. Malloy

[57] ABSTRACT

A back scrubbing device comprising a plate having a main surface from which there extend a plurality of suction cups adapting the device to be mounted to a shower stall wall in a temporary location and, from the other main surface, there extends a plurality of bristles against which one may rub the back to clean it after it has been soaped.

3 Claims, 3 Drawing Figures

BACK SCRUBBING DEVICE

FIELD OF THE INVENTION

This invention relates to a cleaning device and more particularly to a device for use in cleaning, scrubbing or massaging one's back and which is adapted to be mounted temporarily at a location in a shower stall.

BACKGROUND OF THE INVENTION

In the past, there have been numerous types of devices for use in scrubbing one's back. Some of these have been wall mounted and constitute relativel complex devices which are adapted to be moved while in situ so as to accomplish a scrubbing. This invention differs from those devices in that it is adapted to be temporarily mounted at a permanent location by the use of suction cups in a shower stall and, thereafter, the person manipulates its body against brushes extending from the device for scrubbing, massaging or scratching one's back.

OBJECTS OF THIS INVENTION

It is an object of this invention to provde a back scrubbing, massaging and scratching device which is simple and inexpensive to manufacture, is composed of a backing plate which has a plurality of suction cups extending therefrom from one main surface thereof and adapting the same to be mounted to a shower stall wall and a plurality of bristles extending from the other surface adapting the same to be used by a person rubbing his body against it to clean, scrub, massage or scratch it.

It is a general object of this invention to provide a device which can be utilized by the entire family for cleaning one's back, the device being adapted to be simply relocated in a shower stall at the correct height for the particular user.

In accordance with these and other objects which will become apparent hereinafter, the instant device will now be described with reference to the accompanying drawings in which:

DESCRIPTION OF THE PREFERRED EMBODIMENT

Figure 1:
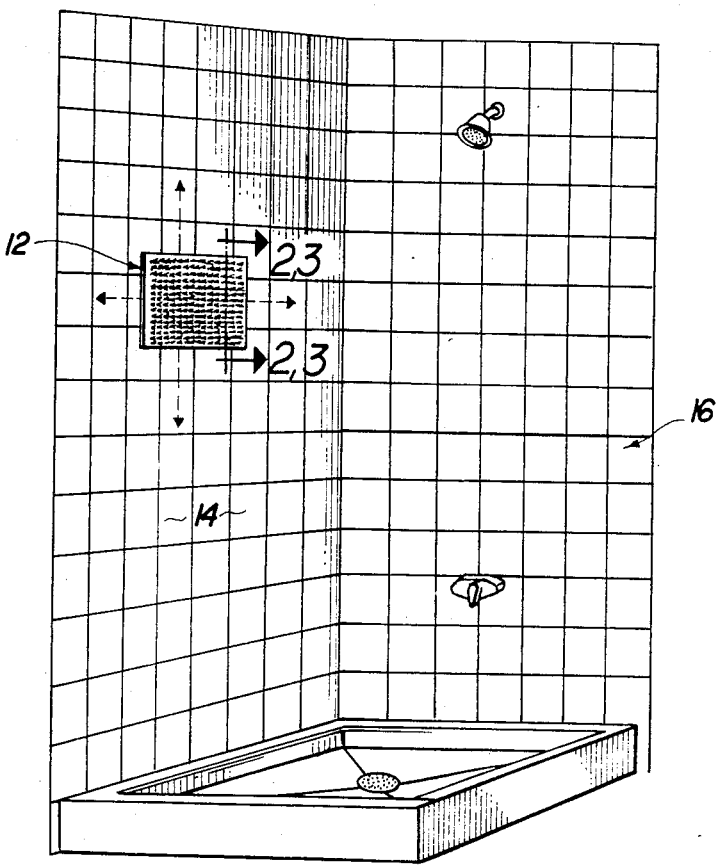
FIG. 1 is a partial view of a shower stall in which the instant invention has been temporarily installed.

Referring to the drawings wherein like reference characters designate like or corresponding parts throughout the several views and referring particularly to FIG. 1, there is shown the back scrubber generally designated by the numeral 12 which has been installed on the wall 14 of a shower stall such as that generally indicated by the numeral 16.

Figure 2:
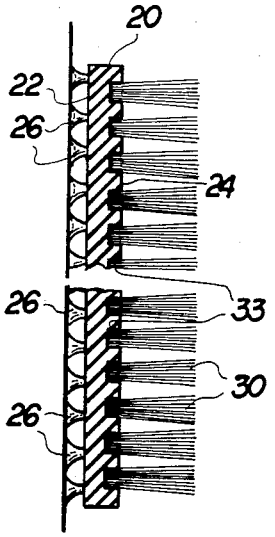
FIG. 2 is a view in cross section taken on the plane indicated by the line 2—2 of FIG. 1 and looking in the direction of the arrows.

Referring to FIG. 2, it is seen that the back scrubber device 12 is composed of a backing plate 20 having two main surfaces 22 and 24. To the main surface 22 of the backing plate 20 there is an array of suction cups 26 made of plastic material and being inherently flexible which is necessary to accomplish a gripping of the wall 14. This adapts the backing plate to be temporarily fastened to the shower stall wall 14 as shown in FIG. 1. Extending outwardly a common distance from the other main surface 24 of the backing plate 20 there is an array of bristles generally designated by the numeral 30. In the preferred embodiment, the width of the device is about 14 inches and the height is about 10 inches; however, it can be oriented by the user in any attitude which is preferred to accommodate the person's height. All that a person using the device does is adjust it on the wall to the height that he wishes it to be located, apply soap to it and, turns around and using it, scrubs the back. In the preferred embodiment shown in FIG. 2, the backing plate 20 is of rubbery and therefore inherently flexible material about ¼ inch in thickness while the bristles are relatively short and sufficiently strong enough to scratch while simultaneously brushing if this is preferred, and in the preferred embodiment, the bristles are of ½ of an inch in length. The bristles are arranged in each of the bristle groups in the array, the groups being spaced from one another by about ⅛ inch and the groups being arranged in rows and columns and being situated in holes of about 1/16 of an inch in diameter, the holes being designated by the numeral 33. Preferably, the suction cups are about ½ of an inch in diameter in their normal configuration prior to application to the wall and may be of the conventional type which is used on products currently available for use in the kitchen and the like to support other type articles.

Figure 3:
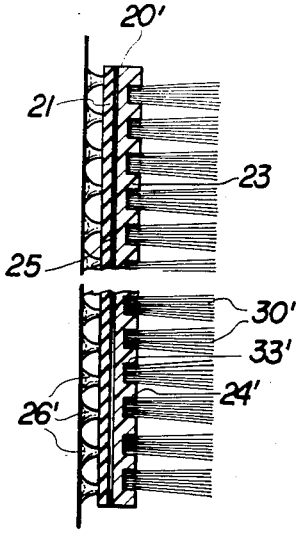
FIG. 3 is a view in cross section of an alternative embodiment of the instant invention resembling the embodiment shown in FIG. 2.

Referring now to FIG. 3, there is a device similar to that shown in FIG. 2 constituting a preferred embodiment wherein the backing plate is designated by the numeral 20' and is seen to be composed of two plate segments 21 and 23 which are of common size and has correspondingly positioned faces mating together along confronting surface 25. Extending outwardly from plate segment 27 of the backing plate are suction cups 26' and outwardly from plate segment 23 are bristle groups 24' situated in recesses 33'. This embodiment differs from that of FIG. 2 in that plate segment 21 of the backing plate 20' is formed of rubber of about 1/16 inch thick while the plate segment 23 carrying the bristles is about 3/16 inch thick and is of relatively hard plastic.

In use, it is seen that a person simply mounts either embodiment of the invention at a suitable location in the shower, soaps up, and then uses it to lean against while scrubbing the person's back which is generally not accessible in order to clean it and to massage it as well as scratch it.

While the instant invention has been shown and described herein in what is considered to be a practical and preferred embodiment, it is recognized that departures may be made within the spirit and scope of this invention, which is, therefore, not to be limited except as set forth in the claims hereinafter within the doctrine of equivalents.

What is claimed is:

1. A back scrubbing device mountable on a vertical support wall surface and comprising:

(a) a backing plate having a substantially planar configuration and comprising at least a first plate segment and a second plate segment, (b) said first and said second plate segments each comprsing a correspondingly positioned inner face fixedly secured together along a confronting surface and an outer exposed face disposed opposite to one another, (c) said plate segments being commonly configured and dimensioned and said first plate segment being formed of a rubbery, substantially flexible material and said second plate segment being thicker than said first plate segment and formed from a hard, rigid material, (d) a plurality of plastic material suction cups removably attachable to the supporting wall surface and secured on said exposed face of said first plate segment in spaced and immediately adjacent relation to one another and collectively disposed in an array over and extending outwardly from said exposed face of said first plate segment, (e) a plurality of brush fingers each comprising a separate bundle of bristles secured to said second plate segment in spaced relation to one another and collectively covering substantially an entire exposed face of said second segment and extending outwardly therefrom in a direction opposite to an outward extension of said plurality of suction cups, (f) said second plate segment being at least minimally displaceably and movable relative to the supporting wall surface due at least in part to inherent flexibility of said platic material of said suction cups and rubbery material of said first plate segment and said rigidity of said second plate segment, and (g) said backing plate being removably securable to the support wall surface and slightly displaceable when secured thereto, whereby forces exerted on said back scrubbing device when coming into contact with a user's body, are at least partially absorbed by said slight displacement.

2. The device as set forth in claim 1 wherein said bristles are about 178 inch in length.

3. The device as set forth in claim 1 wherein the overall length is of about 14 inches and the overall height is of about 10 inches.

* * * * *